US005091893A

United States Patent [19]

Smith et al.

[11] Patent Number: 5,091,893

[45] Date of Patent: Feb. 25, 1992

[54] ULTRASONIC ARRAY WITH A HIGH DENSITY OF ELECTRICAL CONNECTIONS

[75] Inventors: Lowell S. Smith; Charles W. Eichelberger, both of Schenectady; Robert J. Wojnarowksi, Ballston Lake; Wiliam P. Kornrumpf, Albany; Joseph E. Piel, Jr., Scotia, all of N.Y.

[73] Assignee: General Electric Company, Schenectady, N.Y.

[21] Appl. No.: 504,750

[22] Filed: Apr. 5, 1990

[51] Int. Cl.[5] ..... H04R 17/00

[52] U.S. Cl. ..... 367/153; 367/155; 310/334; 29/25.35; 128/662.03

[58] Field of Search ..... 367/140, 153, 155, 138, 367/103; 310/334; 29/25.35; 128/662.03, 660.01, 661.01, 24 A

[56] References Cited

U.S. PATENT DOCUMENTS 4,371,805 2/1983 Diepers et al. ..... 367/155

4,747,192 5/1988 Rokurota ..... 29/25.35

*Primary Examiner*—Deborah L. Kyle

*Assistant Examiner*—J. Woodrow Eldred

*Attorney, Agent, or Firm*—Marvin Snyder; James C. Davis, Jr.

[57] ABSTRACT

A piezoelectric ultrasonic array transducer has its individual elements connected to external electronics via a high density interconnect structure which facilitates signal connection and uniformity from array-to-array. The array fabrication process is preferably modified for use with a high density interconnect structure in order to obtain maximum transducer quality.

26 Claims, 12 Drawing Sheets

ULTRASONIC ARRAY WITH A HIGH DENSITY OF ELECTRICAL CONNECTIONS

RELATED APPLICATIONS

This application is related to U.S. patent application Ser. No. 07/504,765 (07/504,821), entitled "Phased Array Ultrasonic Transducer Including Different Sized Piezoelectric Segments" by L. S. Smith; Application Ser. No. 07/504,821, entitled "High Density Interconnected Microwave Circuit Assembly", by W. P. Kornrumpf, et al.; Application Ser. No. 07/504,769, entitled, "A Flexible High Density Interconnect Structure and Flexibility Interconnected System", by C. W. Eichelberger, et al. each of which is being filed concurrently herewith, and U.S. Pat. No. 4,890,268, entitled "Two-Dimensional Phased Array of Ultrasonic Transducers", by L. S. Smith, W. E. Engeler and M. O'Donnell, each of which is incorporated herein by reference in its entirety.

BACKGROUND OF THE INVENTION

1. Field of the Invention

The present invention relates to the field of ultrasonic transducers, and more particularly, to the field of phased array ultrasonic transducers.

2. Background Information

Array transducers, whether they be ultrasonic transducers as in the case of ultrasonic imaging, or electromagnetic radiating horns as in the case of phase array radars, rely on wave interference for their beam forming effects. The ability to provide a focused beam on transmission and to provide a clear image on reception is dependent on each of the elements of the array having identical transduction characteristics between the electrical signals provided by the system transmitter and the wave transmitted into the medium to be explored and identical transduction functions from a wave in the medium being explored to an electrical signal provided to the signal processing system. It is only when the elements have identical characteristics that phase array combining of the signals from a plurality of elements will provide a clear image. The element characteristic which is used to compare elements is the element impulse response. That is, the element's response when a brief high amplitude electrical or wave pulse is applied to the element.

It is because of this theoretical basis for phased array processing, imaging, and coherent beam forming that phased arrays are fabricated from a plurality of elements having identical impulse responses. Since large and small objects react differently, the prior art has satisfied this requirement by using physically identical transducers in order to provide identical impulse responses.

For a number of years, ultrasound has been used as a non-invasive technique for obtaining image information about the structure of an object which is hidden from view. Ultrasound has become widely known as a medical diagnostic tool. It has also been used as a means for non-destructive testing and analysis in the technical arts.

A phased array of ultrasonic transducer elements is often designed to obtain image data. Such imaging arrays are normally linear arrays which are one element wide in the Y-direction by many elements long in the X-direction of a Cartesian coordinate system. Typically, the connections to the individual elements of a phased array ultrasonic transducer are provided by a ground conductor on a first or patient side of the piezoelectric material and individual signal electrodes on the away-from-the-patent side of the piezoelectric material. Individual signal electrode connections are normally provided by ultrasonic wire bonds to the individual signal electrodes of the individual elements. Wire bonds are a desirable means of making external connections to an ultrasonic array because they have essentially no effect on the acoustic characteristics of the transducer to which they are attached. However, a potential problem with the use of wire bonds is an inability to ensure identical placement of the wire bonds on different arrays. This can result in noise pickup and cross-talk between different signal leads which varies from one array to another, thereby complicating system design, testing and operation.

In the acoustic array transducer art, substantial effort has been expended to develop means for matching the transducer to the object to be examined and for damping any acoustic energy which emerges from the back of the transducer array and for controlling other acoustic properties of the structure in a manner to optimize ultrasonic acoustic array imager performance.

Medical ultrasonic transducer arrays normally operate at a frequency in the vicinity of 1 to 10 MHz. A linear array transducer operating at 5 MHz typically is formed from a block of piezoelectric material which is about 9 mm long by 7 mm wide by 0.4 mm thick and typically includes 64 elements. In the piezoelectric material, a frequency of 5 MHz has an acoustic wavelength of 0.8 mm which is about half the thickness of the piezoelectric body. In the human body, this acoustic frequency has a wavelength of about 0.3 mm, but varies a few percent depending on tissue type and density.

Such medical ultrasonic linear arrays are fabricated from a monolithic block of a ceramic piezoelectric material such as lead zirconate titanate (PZT) which has been made or machined to the desired shape and poled by applying an electric field of about 50,000 volts/cm across the piezoelectric in a direction perpendicular to the face of the array. Techniques for fabricating the basic PZT ceramic material are well known in the art. Once the piezoelectric block has been poled, it is coated with an electrode material such as nickel, gold or copper, gold where the first listed metal of a pair is deposited first and the second listed metal is deposited over that first metal. These metals may be deposited on the piezoelectric by processes such as evaporation, sputtering, electroless and electroplating. Plating is a preferred method of depositing the electrode material. This electrode material preferably coats all surfaces of the piezoelectric block.

An acoustic interface structure is then formed on the front (toward-the-patient) side of the block. This acoustic interface structure normally includes acoustic matching layers to transform the acoustic impedance of the piezoelectric transducer to that of its external environment. Next, the electrode material is separated into ground and signal portions by two partial depth saw cuts whose kerfs extend in the X-direction just inboard from the Y-direction edges of the block. These partial saw kerfs may preferably extend about 80% of the way through the piezoelectric block. By separating the signal and ground electrodes in this manner, the ground electrode is left accessible at the back surface of the block for connection of electrical leads, but physically spaced from the signal electrodes by the thickness of the block of piezoelectric material.

A shallow subdicing of the piezoelectric block with the dicing saw's kerfs extending in the Y-direction defines the location of each element of the final array within the piezoelectric block. This element-defining subdicing may preferably be done with a sequence of cuts of a dicing saw. This subdicing operation is done with shallow kerfs (5-25% of the depth of the piezoelectric block) in order to clearly define the elements of the transducer. This element definition subdicing separates the signal electrode portion of the metallization into individual signal electrodes. By subdicing, we mean cutting into the piezoelectric material, preferably without going all the way through it. This separates the piezoelectric into electrically separate segments, while preferably leaving it as a unitary structure.

Each signal electrode is connected to an external terminal by wire bonding. Individual element-by-element ground electrode connections are also made to a common external ground connection.

The back surface of the array and the back surface of the portion of the front acoustic control structure which extends beyond the piezoelectric block are coated as a unit with an acoustic absorber to damp any acoustic energy emerging from the back surface of the array. This is to prevent any acoustic energy which emerges from the back of the array from being reflected back into the piezoelectric material, something which would modify the acousto-electrical response of the transducer in an undesirable manner. A preferred acoustic absorber is a composite of metal particles in an attenuating soft material such as rubber, epoxy or plastic such as is disclosed in U.S. Pat. No. 4,779,244 to M. S. Horner, et al. However, other absorber may also be used. This acoustic absorber is electrically insulating and is applied as a liquid which flows easily around the wire bond wires and thus helps to prevent accidental shorting among the wire bonds during subsequent handling. Once the acoustic absorbing material has sufficiently set, the transducer is diced into its individual X-direction elements using the same or a similar dicing saw as was used to define the elements. However, this dicing is done from the front of the array. For this dicing operation, the saw blades are accurately aligned with the shallow, element-defining saw kerfs on the back of the array by means of fiducial cuts and the depth of the cut is set deep enough to ensure that X-direction-adjacent elements are physically severed from each other. It is preferred to have the saw kerfs extend beyond the back of the piezoelectric block in order to decrease acoustic cross coupling among the elements. The elements are severed by the intersection of the dicing saw's kerfs with the earlier element-defining saw kerfs. During and after this dicing operation, the individual elements are held in place by the acoustic absorber material. A thin mylar tape is then placed across the front of the array to keep debris out of the saw kerfs and to provide additional element-to-element spacing support. Following this dicing operation, the array is composed of a plurality (typically 28 to 128) individual elements which are typically about $30\lambda_{water}$ long in the Y-direction by $0.5\lambda_{water}$ wide in the X-direction which are separated by 0.05 mm in the X-direction.

In a manner which is well known in the phased array art, appropriate phasing of electrical signals delivered to the individual elements of this linear array can create an ultrasonic acoustic wave which forms a beam which may be steered and focused in the X-Z plane, where the Z axis is perpendicular to the X-Y plane.

During reception, the electrical signals produced by the individual acousto-electrical transducer elements of the phased array are combined in phase and amplitude in the manner which is well known in the phased array art in order to form a beam which is steered in a selected direction. Typically, the transmitted and received beams are steered in the same direction for a maximum signal-to-noise ratio and image resolution.

Focus in the Y-direction (for both transmission and reception) has normally been provided by a fixed mechanical acoustic lens with the result that the ultrasonic beam is only in proper Y-direction focus in the vicinity of a pre-established focal depth.

There has been a need for improved focus in the Y-direction. The above-identified related U.S. Pat. No. 4,890,268 discloses a solution to this Y-direction focus problem in the form of a two-dimensional array of ultrasonic transducer elements which approximates a Fresnel lens and enables electronic Y-direction focus of the ultrasonic beam as a means of overcoming this Y-direction out-of-focus problem. This array is typically fabricated from a block of material having maximum exterior dimensions of $50\lambda_{water}$ by $50\lambda_{water}$ by $0.5\lambda_{transducer}$, where $\lambda_{water}$ is the wavelength of the operating frequency in water and $\lambda_{transducer}$ is the wavelength of the operating frequency in the transducer material.

The two-dimensional array nature of the transducer of U.S. Pat. No. 4,890,268 complicates the use of wire bonds to provide the individual signal conductors for the various elements of the ultrasonic array. For an eight subarray structure of the type illustrated in U.S. Pat. No. 4,890,268, eight wire bonds (one for each subarray) must be made to each column of the array. For the array in U.S. Pat. No. 4,890,268, 520 signal lead bonds must be made in an area $0.6\times0.6$ inch which requires bonds at a density of 1,440 per square inch. A separate ground lead connection is also required for each column. This is beyond the capability of presently available wiring bonding systems. The close proximity of those wire bonds wires would substantially increase cross-talk, noise pickup and accidental short circuit problems. Consequently, U.S. Pat. No. 4,890,268 suggests the use of a high density interconnect technique for connection of the transducer to external terminals.

A number of high density interconnection techniques are known in the art. One of these high density interconnect structures which is also known as HDI, has been developed at General Electric Company and is the subject of a number of U.S. patents and patent applications. This General Electric high density interconnect structure has been developed in order to provide a reliable, cost effective means of interconnecting a multiplicity of electronic components such as integrated circuit chips to form a compact unitary structure for a complex (high gate count) electronic system. This HDI structure accomplishes this by doing away with individual packages for the individual chips and instead interconnecting the chips in a much denser manner.

This system overcomes the problem of low system yield which plagued previous attempts to interconnect many complex chips into an even more complex system by providing the ability to remove the high density interconnect structure in the event of an error in the high density interconnect structure itself or in the event of failure of one or more of the chips, all without any adverse effect on the good chips. Subsequently, a new high density interconnect structure may be applied to the repaired system. This repair capability is considered necessary for the interconnection of a significant number of high cost chips into a single system because chip pretesting is often incapable of establishing with certainty that chips which test "good" will, in fact, operate together in the manner intended for system. This failure to operate properly can be a result of the system operating at higher speeds that the chips are tested at, from an inability to fully specify the required chip characteristics, from an inability to measure those characteristics with sufficient accuracy or because of other causes.

This type of high density interconnect structure, methods of fabricating it and tools for fabricating it are disclosed in U.S. Pat. No. 4,783,695, entitled "Multichip Integrated Circuit Packaging Configuration and Method" by C. W. Eichelberger, et al.; U.S. Pat. No. 4,835,704, entitled "Adaptive Lithography System to Provide High Density Interconnect" by C. W. Eichelberger, et al.; U.S. Pat. No. 4,714,516, entitled "Method to Produce Via Holes in Polymer Dielectrics for Multiple Electronic Circuit Chip Packaging" by C. W. Eichelberger, et al.; U.S. Pat. No. 4,780,177, entitled "Excimer Laser Patterning of a Novel Resist" by R. J. Wojnarowski et al.; U.S. patent application Ser. No. 249,927, filed Sept. 27, 1989, entitled "Method and Apparatus for Removing Components Bonded to a Substrate" by R. J. Wojnarowski, et al.; U.S. patent application Ser. No. 310,149, filed Feb. 14, 1989, entitled "Laser Beam Scanning Method for Forming Via Holes in Polymer Materials" by C. W. Eichelberger, et al.; U.S. patent application Ser. No. 312,798, filed Feb. 21, 1989, entitled "High Density Interconnect Thermoplastic Die Attach Material and Solvent Die Attachment Processing" by R. J. Wojnarowski, et al.; U.S. patent application Ser. No. 283,095, filed Dec. 12, 1988, entitled "Simplified Method for Repair of High Density Interconnect Circuits" by C. W. Eichelberger, et al.; U.S. patent application Ser. No. 305,314, filed Feb. 3, 1989, entitled "Fabrication Process and Integrated Circuit Test Structure" by H. S. Cole, et al.; U.S. patent application Ser. No. 250,010, filed Sep. 27, 1988, entitled "High Density Interconnect With High Volumetric Efficiency" by C. W. Eichelberger, et al.; U.S. patent application Ser. No. 329,478, filed Mar. 28, 1989, entitled "Die Attachment Method for Use in High Density Interconnected Assemblies" by R. J. Wojnarowski, et al.; U.S. patent application Ser. No. 253,020, filed Oct. 4, 1988, entitled "Laser Interconnect Process" by H. S. Cole, et al.; U.S. patent application Ser. No. 230,654, filed Aug. 5, 1988, entitled "Method and Configuration for Testing Electronic Circuits and Integrated Circuit Chips Using a Removable Overlay Layer" by C. W. Eichelberger, et al.; U.S. patent application Ser. No. 233,965, filed Aug. 8, 1988, entitled "Direct Deposition of Metal Patterns for Use in Integrated Circuit Devices" by Y. S. Liu, et al.; U.S. patent application Ser. No. 237,638, filed Aug. 23, 1988, entitled "Method for Photopatterning Metallization Via UV Laser Ablation of the Activator" by Y. S. Liu, et al.; U.S. patent application Ser. No. 237,685, filed Aug. 25, 1988, entitled "Direct Writing of Refractory Metal Lines for Use in Integrated Circuit Devices" by Y. S. Liu, et al.; U.S. patent application Ser. No. 240,367, filed Aug. 30, 1988, entitled "Method and Apparatus for Packaging Integrated Circuit Chips Employing a Polymer Film Overlay Layer" by C. W. Eichelberger, et al.; U.S. patent application Ser. No. 342,153, filed Apr. 24, 1989, entitled "Method of Processing Siloxane-Polyimides for Electronic Packaging Applications" by H. S. Cole, et al.; U.S. patent application Ser. No. 289,944, filed Dec. 27, 1988, entitled "Selective Electrolytic Deposition on Conductive and Non-Conductive Substrates" by Y. S. Liu, et al.; U.S. patent application Ser. No. 312,536, filed Feb. 17, 1989, entitled "Method of Bonding a Thermoset Film To a Thermoplastic Material to Form a Bondable Laminate" by R. J. Wojnarowski; U.S. patent application Ser. No. 363,646, filed June 8, 1989, entitled "Integrated Circuit Packaging Configuration for Rapid Customized Design and Unique Test Capability" by C. W. Eichelberger, et al.; U.S. patent application Ser. No. 07/459,844, filed Jan. 2, 1990, entitled "Area-Selective Metallization Process" by H. S. Cole, et al.; U.S. patent application Ser. No. 07/457,023, filed Dec. 26, 1989, entitled "Locally Orientation Specific Routing System" by T. R. Haller, et al.; U.S. patent application Ser. No. 456,421, filed Dec. 26, 1989, entitled "Laser Ablatable Polymer Dielectrics and Methods" by H. S. Cole, et al.; U.S. patent application Ser. No. 454,546, filed Dec. 21, 1989, entitled "Hermetic High Density Interconnected Electronic System" by W. P. Kornrumpf, et al.; U.S. patent application Ser. No. 07/457,1217, filed Dec. 26, 1989, entitled "Enhanced Fluorescence Polymers and Interconnect Structures Using Them" by H. S. Cole, et al.; and U.S. patent application Ser. No. 454,545, filed Dec. 21, 1989, entitled "An Epoxy/Polyimide Copolymer Blend Dielectric and Layered Circuits Incorporating It" by C. W. Eichelberger, et al. Each of these Patents and Patent applications is incorporated herein by reference.

This high density interconnect structure has been applied to electrical circuits such as digital systems in which the electrical interconnection of elements is the significant feature of the system and the interconnection structure. Acoustic effects beyond the absence of excessive conversion of acoustic vibrations to electrical noise has not be a significant concern in this HDI structure. Consequently, what acoustic effects such as HDI structure might have on a piezoelectric array transducer are unknown. Possible effects include inducing modifications in the impulse responses of the individual elements, inducing electrical or acoustic cross-talk between adjacent elements and other effects, all of which would degrade the overall system performance of an ultrasonic acoustic array imaging system.

The introduction of a high density interconnect structure between the back of the array and acoustic damping material is undesirable from an acoustic point of view since it creates a new structure with unknown internal acoustic interactions and carries with it risks of adverse acoustic interactions which could increase noise, modify element impulse response characteristics and decrease image quality.

Acoustic and electrical interactions between the piezoelectric body of the transducer and a high density interconnect structure are unknown. Electrical or acoustic loading effects and acoustic vibrational effects may both be present with a consequent possibility of resonances which interfere with proper operation of the ultrasonic transducer array.

Accordingly, there is a need for a high density interconnection structure which is compatible with medical two-dimensional array ultrasonic transducer structures and fabrication techniques and which does not adversely affect either individual element operational characteristics or the overall operational characteristics of the phased array.

OBJECTS OF THE INVENTION

Accordingly, a primary object of the present invention is to provide an array ultrasonic transducer having a well-defined signal conductor structure which minimizes cross-talk and other signal degradation phenomena.

Another object of the present invention is to provide a controlled configuration, minimal cross-talk, signal lead configuration whose characteristics are essentially unchanged from one array to another.

Another object of the present invention is to provide a high yield, reliable fabrication process for connecting signal conductors to the signal electrodes on the piezoelectric body of an array ultrasonic transducer.

Still another object of the present invention is to provide a process for fabricating an HDI interconnected piezoelectric array transducer which is free of adverse effects on the piezoelectric material.

SUMMARY OF THE INVENTION

The above and other objects which will become apparent from the specification as a whole, including the drawings, are achieved in accordance with the present invention by avoiding the element defining shallow subdicing of the back of the piezoelectric block, by providing an HDI structure in which the conductors extend parallel to the Y-direction and are excluded from the region over the gaps between X-direction adjacent elements of the array. In accordance with one embodiment of the present invention, the dielectric of the high density interconnect structure is restricted to being disposed directly under the conductors of the high density interconnect structure. This eliminates adverse acoustic effects which can result from the dielectric of the high density interconnect structure extending across the entire back of the array or even just being disposed in contact with the entire back of each of the elements.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION

Figure 1:
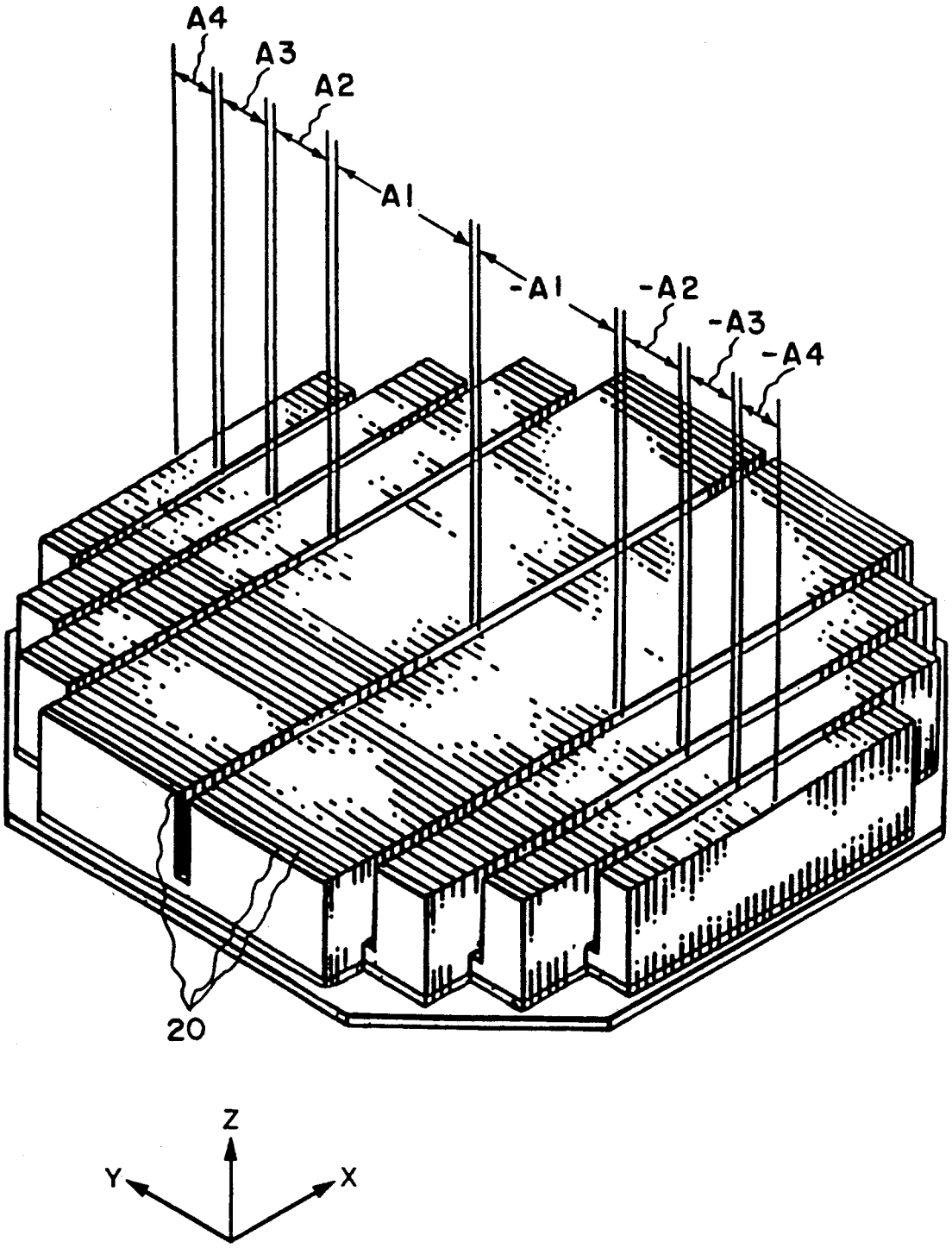
FIG. 1 illustrates a two-dimensional ultrasonic transducer array in accordance with U.S. Pat. No. 4,890,268.

A two-dimensional ultrasonic acoustic transducer array like that disclosed in U.S. Pat. No. 4,890,269 is shown in perspective in FIG. 1. This array comprises eight rows or subarrays of ultrasonic elements 20, these rows being designated $\pm A_1$, $\pm A_2$, $\pm A_3$ and $\pm A_4$, where the minus sign indicates a subarray which is disposed below the X-axis (along the negative Y-axis in the figure). In accordance with U.S. Pat. No. 4,890,268, each of the subarrays of this transducer is divided into a plurality of elements in the X-direction. An objective of the present invention is to provide signal contacts to each of the signal electrodes of this array for connecting the individual elements of the array to the external electronics which drive this array and process signals from this array.

U.S. Pat. No. 4,890,268 teaches fabrication of this array from a 2—2 composite of slabs of piezoelectric material and slabs of acoustically inert material such as epoxy. A 2—2 composite is one in which the material of each of its two components is connected to itself over large distances in only two perpendicular directions. That is, the structure from which the array is fabricated is essentially a multilayer piezoelectric/epoxy laminate comprised of alternating slabs of piezoelectric material and acoustically inactive material. These slabs are oriented with their major faces disposed parallel to the X-Z plane (the plane which is perpendicular to the face of the array and contains the X-axis). The array is then fabricated in a manner similar to that which has been described in the Background Information portion of this specification with respect to the fabrication of linear arrays from monolithic blocks of piezoelectric material. That is, subdicing cuts are made parallel to the X-axis to divide the unitary 2—2 composite structure into the eight separate subarrays $\pm A_1$ through $\pm A_4$. Element-locating, shallow subdicing is then be done on the back surface to define the location of the individual elements of the array. Leads may then be attached, the structure inverted and diced from the front side to separate the individual columns of this structure from each other to provide an array structure in which adjacent elements in the X-direction are highly acoustically isolated from each other.

A number of problems were encountered in attempting to apply the HDI structure and fabrication techniques taught in the background HDI patents and applications to the connection of the elements of this type of piezoelectric array.

First, random segments of the piezoelectric material became depoled during the fabrication process. Some of these depoled regions could be repoled by applying a poling electric field of about 50,000 volts across the piezoelectric. However, in other cases, the crystal structure of these regions had changed so that they could not be repoled. We have identified the cause of this problem as being arcing within the structure as a result of thermally induced voltages in the PZT. This is a result of heating the structure to a temperature in the range from about 150° C. to about 230° C. during the process of laminating the polyimide dielectric layer 52 to the back of the transducer, the specific temperature depending on the particular polymer which is used as the thermoplastic adhesive in this lamination process. The thermal expansion of the piezoelectric material results in the creation of large voltages across the piezoelectric material and arcing which sufficiently heats the piezoelectric to depole it or even to change its crystal structure. We have found that both depoling and changes in the crystal structure can be avoided by eliminating from the process the element-defining shallow subdicing of the structure to isolate individual signal electrodes of individual elements from each other prior to the application of the signal conductors.

Figure 5:
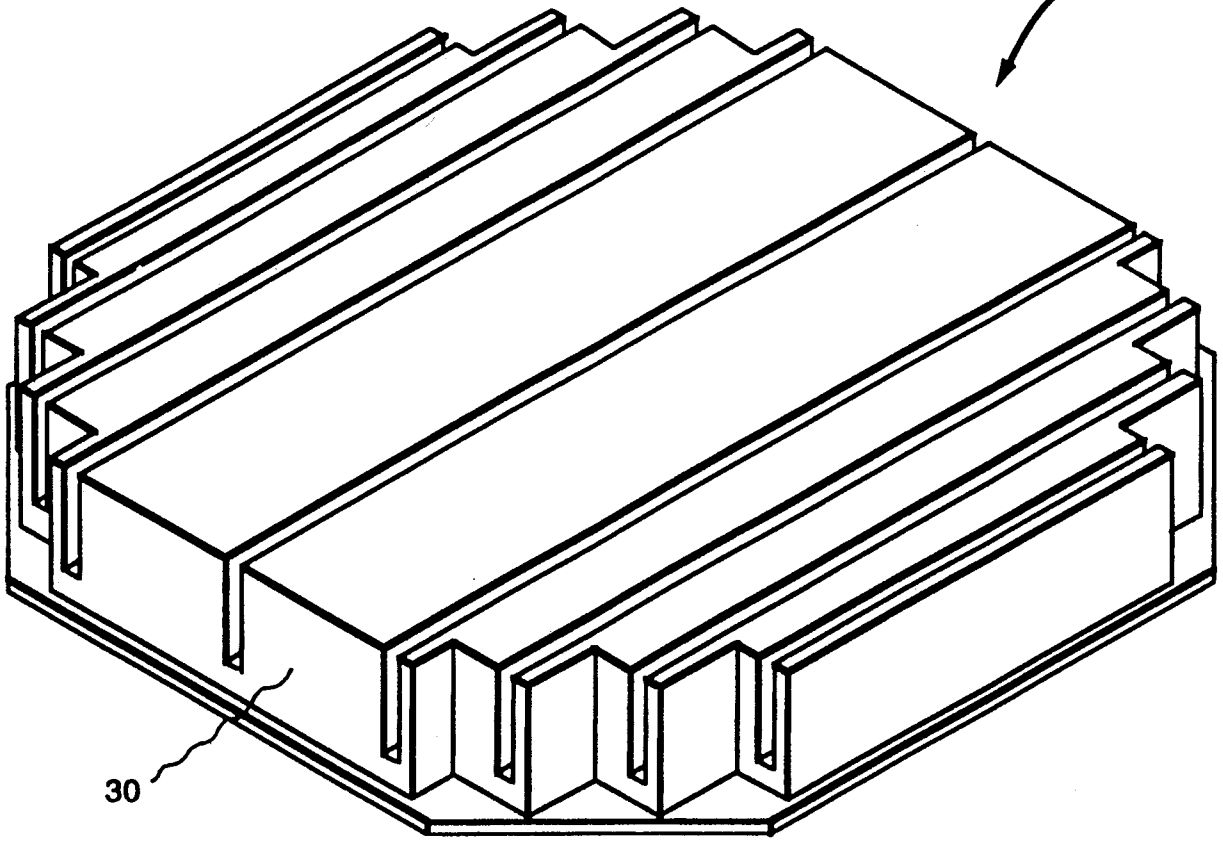
FIG. 5 illustrates an array of the FIG. 1 type at an early stage in a fabrication process in accordance with the present invention.

It is for this reason that the structure illustrated in FIGS. 5-7 (to be discussed hereinafter) is completed prior to any dicing or subdicing which separates the signal electrodes of X-direction adjacent elements from each other. That is, the individual signal leads for subarray $A_4$ are all connected to a single signal electrode during the interconnect fabrication process. It will be noted that while the individual signal electrode segments on the different subarrays in FIGS. 7 and 8 (to be discussed hereinafter) give the appearance of being electrically isolated from each other, they are not in fact isolated from each other. This is because at the X-direction ends of this block, the electrode metallization extends over the end of the block in FIG. 7 with the result that the entire metallization layer 28 is continuous over the entire surface of the body other than within the subdicing saw kerfs 32. Thus, where a sufficiently high temperature is used during the fabrication process to raise a risk of inducing arcing along the surface of the piezoelectric material, it is important to the fabrication process that the electrode metallization on the exterior surfaces of the piezoelectric body remain electrically connected, and preferably shorted to each other to avoid this arcing problem. As an alternative, although not preferred, process, the element-locating subdicing could be performed and those subdiced saw kerfs provided with a resistive material to bridge the gap between the adjacent signal conductor electrodes to prevent the build up of large voltage differences across the piezoelectric material. In that event, the dicing which separates adjacent columns from each other could remove that resistive material to result in a transducer structure which was substantially identical to that produced in accordance with the preferred method of fabrication.

Figure 2:
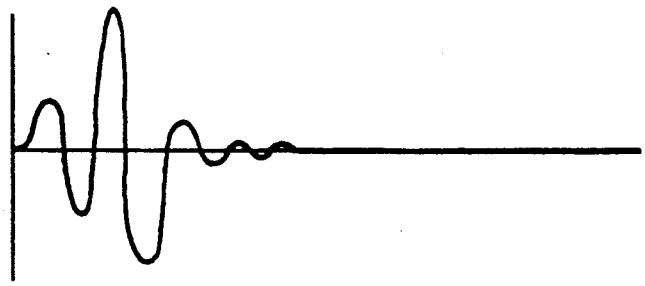
FIGS. 2-4 illustrate the impulse responses of a wire bonded element, a high density interconnected element and an element which is high density interconnected in a modified manner, respectively.
Figure 3:
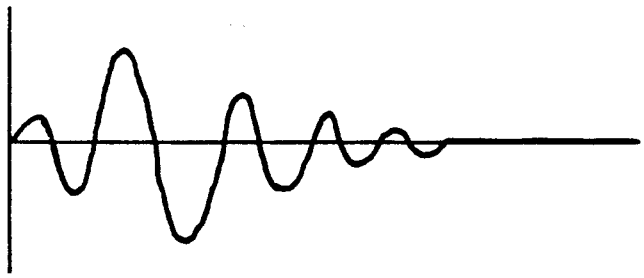

The high density interconnect structure adversely affected the impulse response of the individual elements of the transducer in that it substantially lengthened the impulse response of the elements (by about 30%). FIG. 2 is an oscilloscope trace of the impulse response of an element connected by a wire bond, while FIG. 3 is a similar oscilloscope trace (same oscilloscope settings, etc.) of the impulse response of an element connected by a high density interconnect structure of the type taught in the background HDI patents and applications. This prolongation of the impulse response adversely affects beam formation, image extraction and other important operational characteristics of an ultrasonic array imager system. Because the signal processing involves convolution of the element impulse response with the received signals, lengthening of the impulse response increases the length of the minimum resolvable distance between image features and thus drastically reduces image resolution. Such a reduction in image quality is undesirable, since the purpose of the 2-D array is to improve image quality.

We have determined that this adverse effect of the HDI interconnect structure on the element impulse response is a result of multiple reflections of acoustic waves within the HDI structure. This multiple reflection effect also creates cross-talk between adjacent elements. This multiple reflection effect and the increased duration of the element impulse response and the increased cross-talk it produces can be substantially reduced by modifying the HDI structure.

Figure 4:
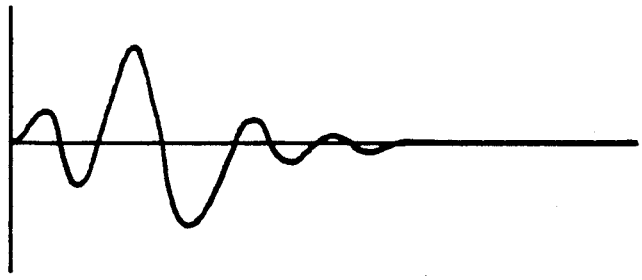

FIG. 4 illustrates the impulse response of an element whose signal lead is connected by a modified high density interconnect structure in accordance with the present invention.

In accordance with the present invention, a phased array ultrasonic transducer is provided with external signal connections by a high density interconnect structure of the general type discussed in the background portion of the specification and the patents cited therein. In FIG. 5, a block 30 of piezoelectric material suitable for the fabrication of a two-dimensional array ultrasonic transducer of the general type disclosed in U.S. Pat. No. 4,890,268 is illustrated in perspective view. At this stage, the structure has been subdiced to form eight separate subarrays as in U.S. Pat. No. 4,890,268, as part of the process of fabricating an array 10 in accordance with the present invention. However, no element-locating subdicing is done in this process. The phased array 10 in FIG. 5 may be made from a 2—2 composite as taught in U.S. Pat. No. 4,890,268 or from a single monolithic block of piezoelectric material which is subdiced as taught in related application Ser. No. 07/504,765.

Figure 6:
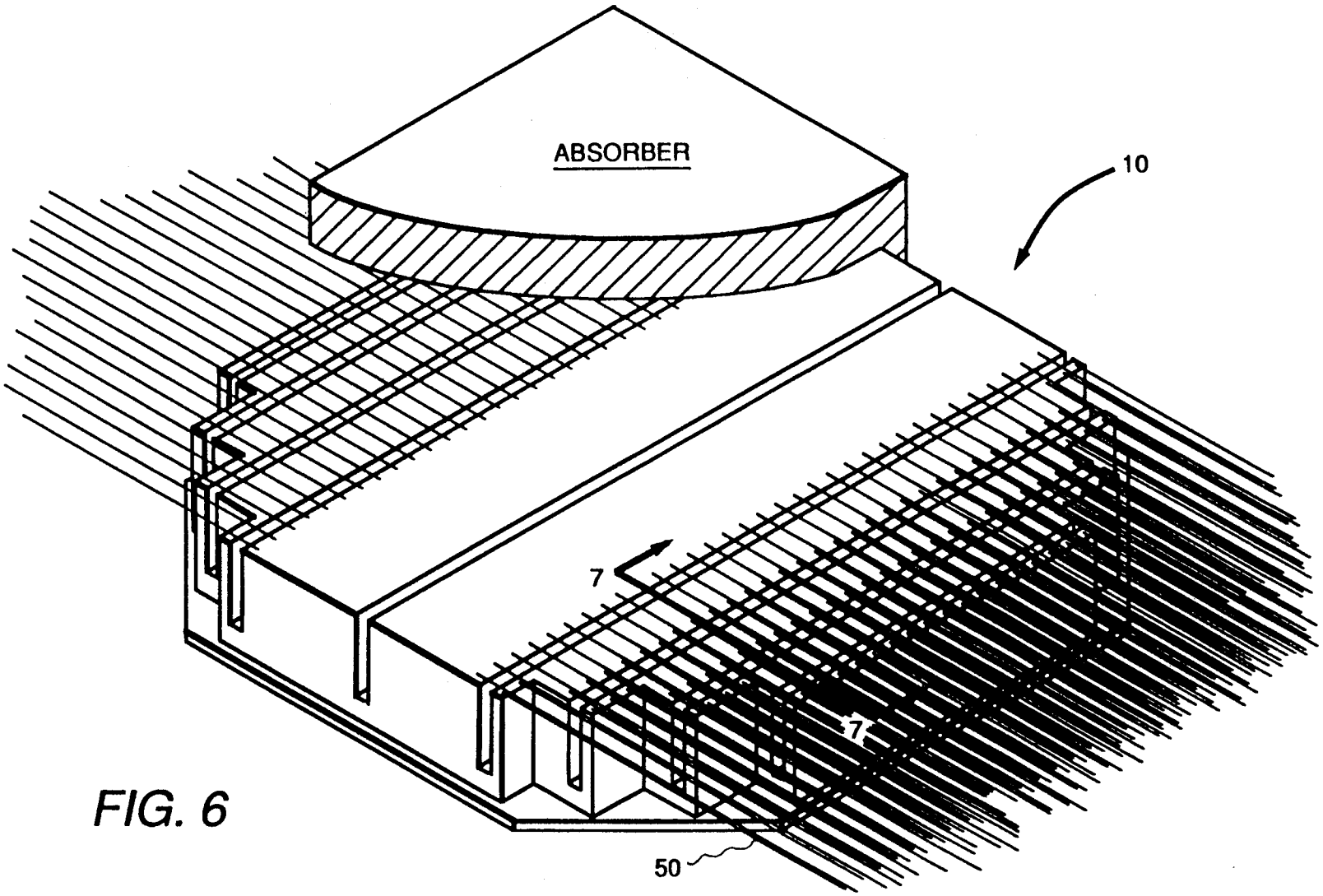
FIG. 6 illustrates the array of FIG. 5 with signal electrodes attached thereto in a high density interconnection manner in accordance with the present invention.

In FIG. 6, the array 10 is schematically illustrated with a high density interconnect structure 50 providing external signal connections to each of the elements of the final structure. A portion of this high density interconnect structure is shown in greater detail in FIG. 7 in a cross-section taken along the line 7—7 in FIG. 6.

Figure 7:
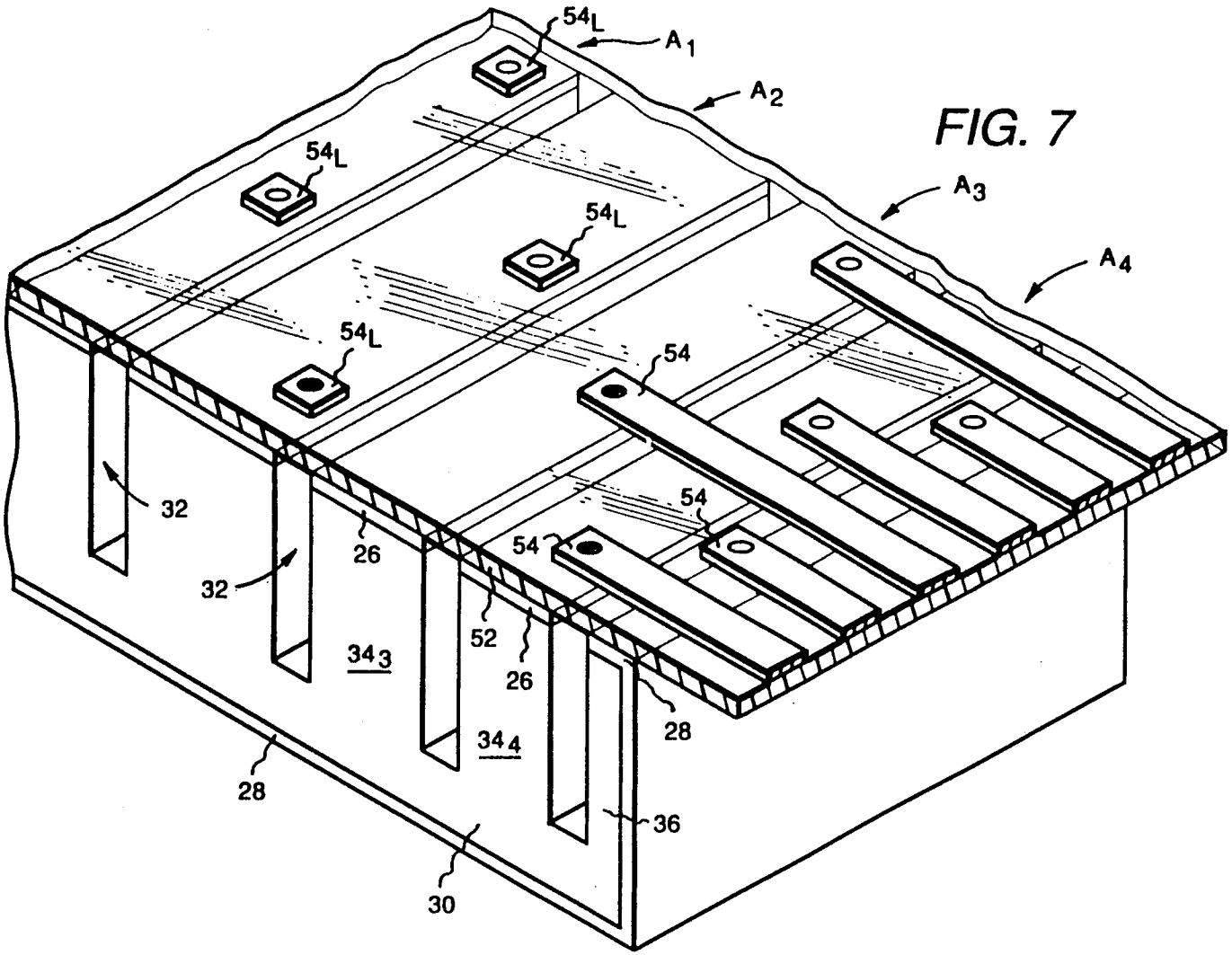
FIGS. 7 and 8 are details at different stages of the process of applying the signal conductors to the ultrasonic transducer.

The condition of this structure is illustrated in FIG. 7 at an intermediate stage of the fabrication process. A layer 52 of dielectric material is disposed across the back surface (top surface in the figure) of the piezoelectric body 30. This dielectric layer preferably comprises a thermoset polyimide material such as KAPTON® polyimide available from E. I. DuPont de Nemours adhesively bonded to the back surface of the metallization on the piezoelectric body by a thermoplastic adhesive. This thermoplastic adhesive may preferably be Ultem® polyetherimide resin which is available from General Electric Company.

A plurality of individual high density interconnect conductors 54 are disposed on dielectric layer 52. Each of these conductors 54 is connected through a via hole in the dielectric 52 to the metallization on one of the other three segments of the body 20. That is, to what will be one of the subarrays $+A_3$ or $+A_4$ or the ground connection block associated therewith. The pattern of the conductors 54 repeats with a period of three conductors. The conductor nearest the viewer in this figure connects to the outermost or $A_4$ subarray or row of the transducer, the next conductor 54 connects to the ground electrode 28 which is brought to the back surface of the piezoelectric along the surface of a step portion 36 of the piezoelectric body. The third conductor extends beyond the other two and is connected to the third subarray or row $A_3$ of the piezoelectric body. This pattern of three conductors repeats along the full X-direction width of the $+A_4$ subarray. In addition to these conductors, isolated landing conductors $54_L$ are disposed over and connected through vias to the signal electrode material for the subarrays or rows $A_1$ and $A_2$.

This interconnection structure includes unique features when it is fabricated by first bonding the dielectric layer to the underlying piezoelectric structure, then forming the via holes in the dielectric by laser "drilling" from above and then depositing the metal of the conductors 54 over the dielectric and in the via holes where it makes ohmic contact to the underlying portion of the signal electrode 26. In particular, the external configuration of the metal in the via hole takes on the shape of the via hole, rather than vice versa as would be the case if the metal were formed first (as by wire bonding or other processes) and the dielectric filled in around it. The nature of the laser drilling process, which is used to form the via holes by drilling from the top, typically results in a via hole which is wider at the top than at the bottom. This via hole shape provides improved metal continuity between the portion of a conductor which is disposed at the bottom of a via hole and the portion which is outside the via hole. This is because the via hole wall surface on which the metal is deposited has a sloping-upward-and-outward configuration which is known from the semiconductor arts to result in a deposited metallization layer achieving better step coverage than is achieved where the step has a vertical wall surface. The term step coverage refers to the uniformity of the metal coverage where the deposition surface changes levels from one planar surface area (the bottom of the via hole) to another planar surface area (the top of the dielectric layer). When the conductors are formed in accordance with the preferred manner described in the background patents and patent applications, the upper surface of the metal conductor typically has a depression or dimple in it at the via hole because the metal of the conductors is deposited to a substantially uniform thickness everywhere, including in the via holes (which are not filled prior to deposition of the metal across the planar surface of the dielectric layer). Consequently, the surface topology of the metallization is similar to the surface topology of the layer on which it is deposited.

Figure 8:
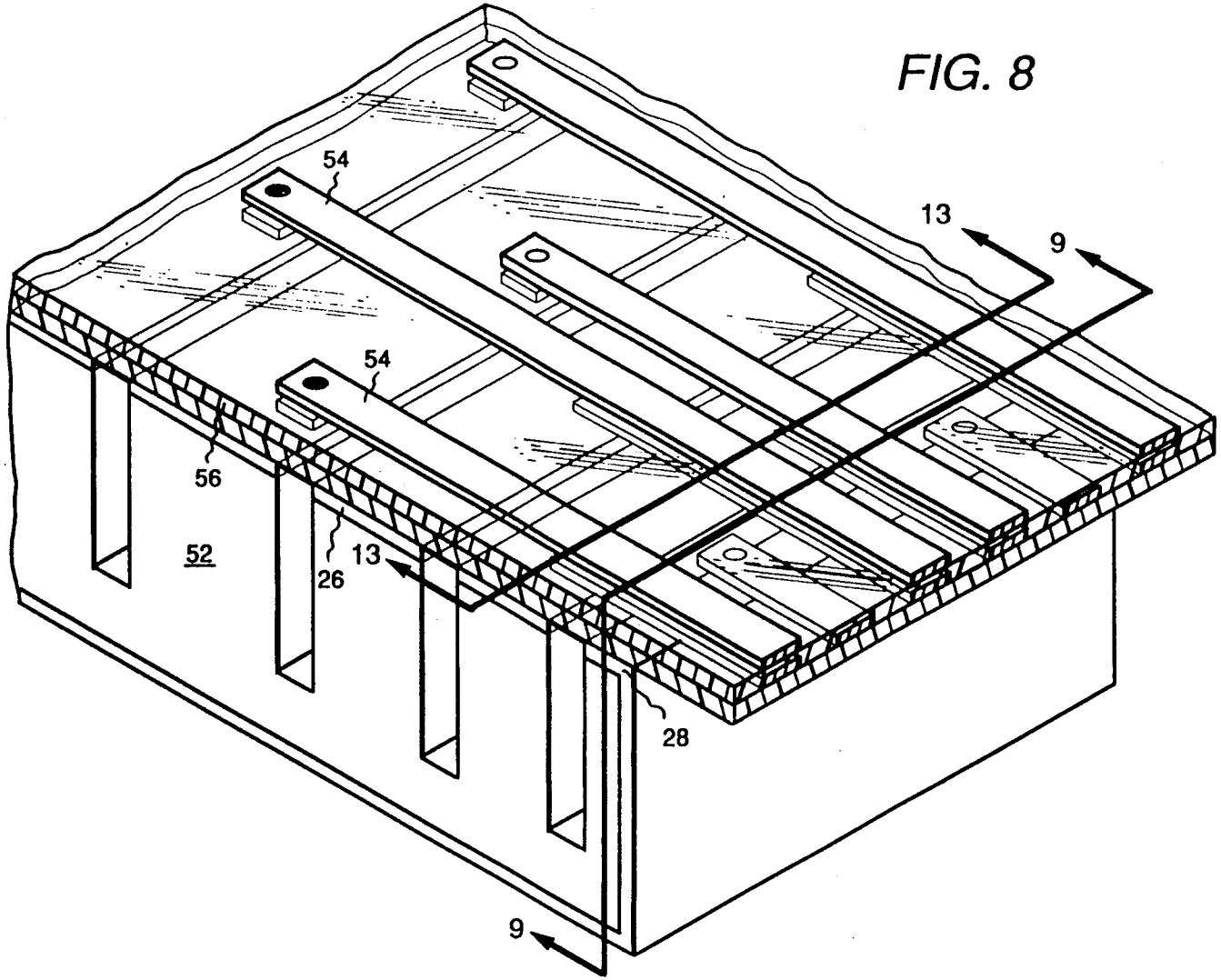

In FIG. 8, the structure of FIG. 7 is illustrated after completion of the fabrication of the signal conductors. This structure differs from the structure in FIG. 7 by the addition of a second dielectric layer 56 and further conductors 54 which are disposed on top of this second dielectric layer. The conductor nearest the observer on top of the dielectric layer 56 extends further than any of the first level conductors to over the second subarray $A_2$ where it connects through a via in dielectric 56 to the landing metallization $54_L$ which is already connected to subarray $A_2$. This conductor 54 is positioned in a vertically aligned (overlapping) relation to the nearest-to-the-viewer first level conductor 54 in FIG. 7.

There is no second level conductor disposed in vertical alignment with the ground conductor 54 of FIG. 7. Next, a still longer conductor 54 extends out to the subarray $A_1$ and is connected through a via hole to the landing metallization $54_L$ connected thereto. This pattern of conductors then repeats in a manner similar to that of the conductors in FIG. 7.

Figure 9:
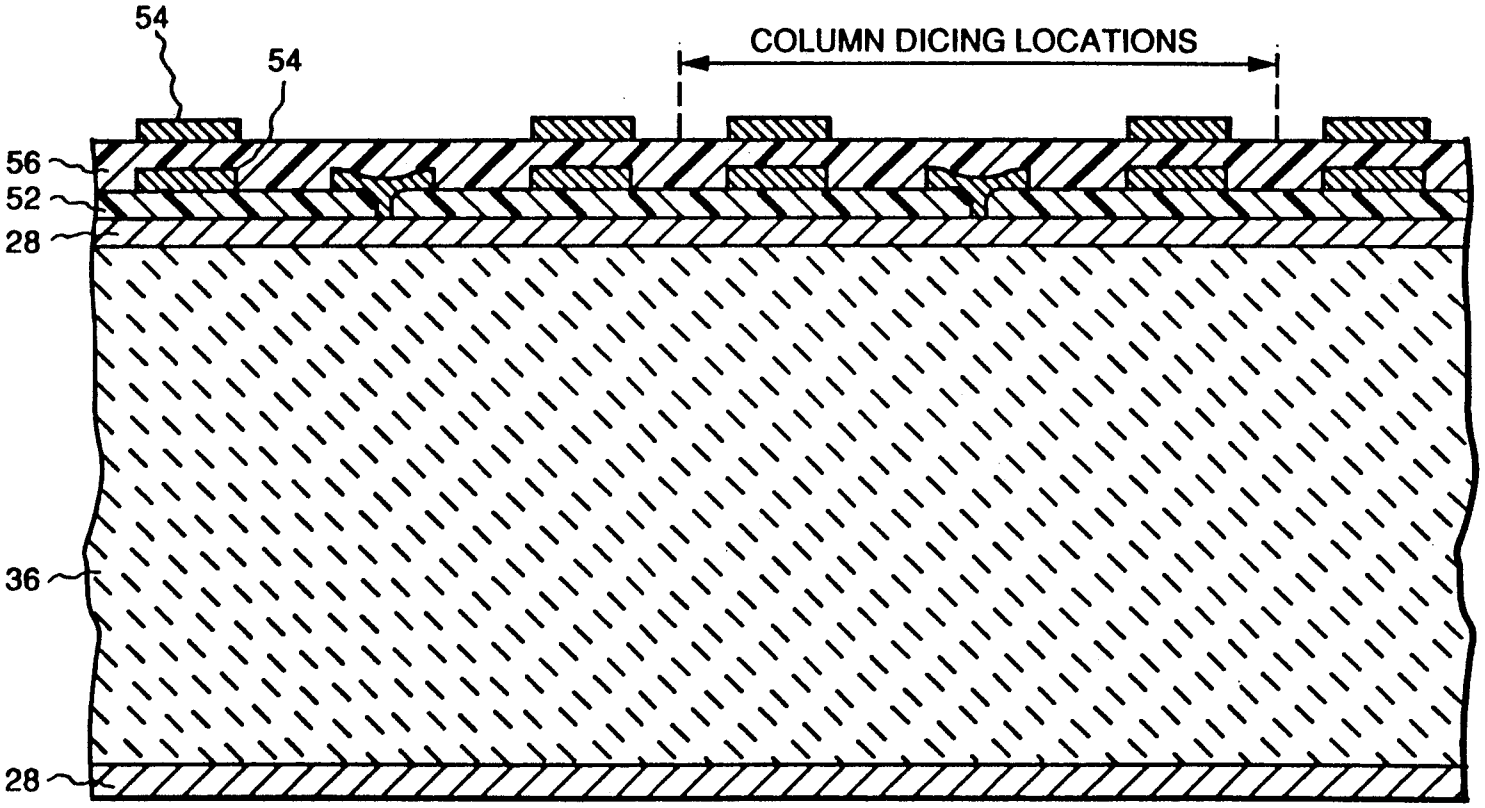
FIG. 9 is a cross-section through the structure of FIG. 8 taken along the line 9—9.
Figure 10:
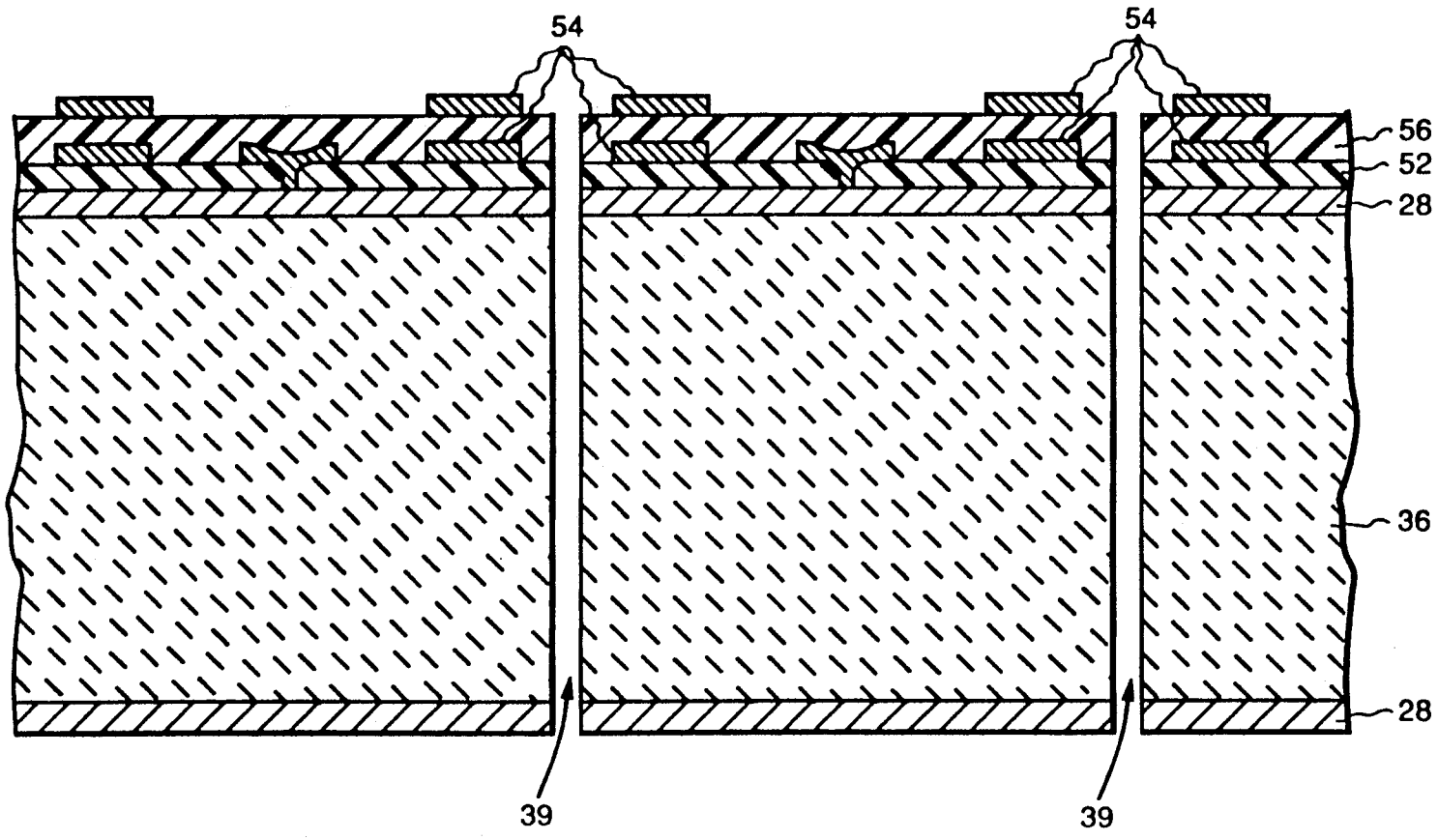
FIG. 10 illustrates the FIG. 9 structure after dicing of the piezoelectric into individual columns or elements.

FIG. 9 is a cross-section through the structure of FIG. 8 taken along the line 9—9 in FIG. 8. The vertical alignment of the first and second level conductors is readily apparent. The conductors 54 are substantially 1 mil wide, with $\geqq 1$ mil gaps therebetween with the result that the three conductors 54 span a minimum width of 5 mils. Since the desired width in the X-direction for an element is 7 mils, a gap of about 1.3 mils is preferably employed in between the conductors 54 for one column with the conductors positioned to leave gaps of about 0.7 mil between the outer conductors for that column and the edge of the element after dicing. This allows for slight misalignments during the dicing operation. In order to separate the unitary block 30 of piezoelectric material into a plurality of separate columns, this structure is diced from the front (lower) side using saw kerfs 39 disposed parallel to the Y-axis. FIG. 10 is a cross-section like that of FIG. 9, but taken after the dicing of the wafer into the separate columns. As will be observed, each column has a common ground conductor and a full set of signal conductors disposed thereover which provide signal connections from the individual elements of that column to external electronics. The dicing of this structure is performed without cutting any of the high density interconnect conductors because of their parallel-to-the-column orientation.

Figure 11:
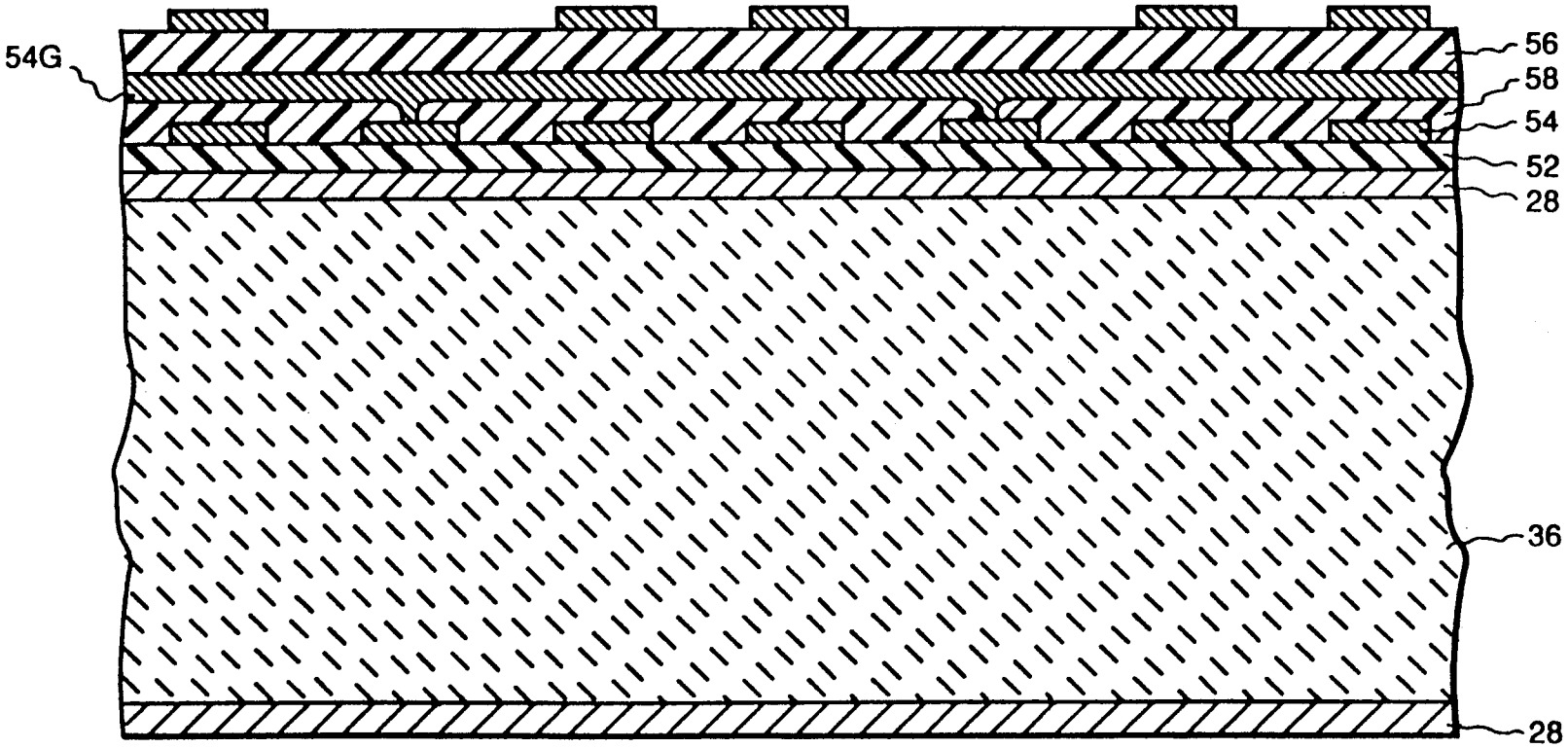
FIG. 11 illustrates an alternative configuration for the structure at the FIG. 9 stage of the process.

While it is not necessary for the dicing operation to extend through the dielectric layers 52 and 56, such extension is considered desirable from a fabrication tolerance point of view since the overall high density interconnect structure has a total top-to-bottom thickness of a few mils and extending the dicing cut through the dielectrics 54 and 56 ensures that the individual signal electrodes 26 disposed on the back of the piezoelectric material are fully severed from each other in the X-direction, thereby isolating the elements electrically. Further, it is desired to have maximum element-to-element isolation in the X-direction to provide maximum resolution in beam forming and dicing through the dielectric layers facilitates such isolation. Finally, dicing all the way through the dielectric layers 52 and 56 prevents acoustic reflections within these layers from producing cross-talk between X-direction adjacent elements.

Where greater element-to-element electrical isolation is desired within a column, it may be considered desirable to modify this high density interconnect structure by providing an additional layer of conductors within the HDI structure to serve as a ground plane to isolate the conductors 54 disposed on the dielectric layer 52 from the overlying conductors disposed on the dielectric layer 56. Such a construction is shown in cross-section in FIG. 11. That is, a third dielectric layer 58 and a ground conductor $54_G$ are interposed between the first level dielectric 52 and the conductors 54 thereon and the second level dielectric 56.

The addition of this high density interconnect structure to the back of the piezoelectric body (that is, between the piezoelectric body and the acoustic absorber disposed thereover) creates a problem of trapping acoustic waves in the dielectric layers 52, 56 and 58 of the HDI structure (which modifies the impulse responses of the individual elements by stretching out the duration of their impulse responses). This problem is avoided or reduced by, after completion of the fabrication of the high density interconnect structure, removing the dielectric layers 52, 56 and 58 everywhere except where they are directly under one of the conductors 54. This structure is shown in cross-section in FIG. 12. In this manner, the back of most of the structure is accessible for direct contact by the acoustic absorber 60 and the absorber is disposed in a more effective manner for damping that acoustic wave as rapidly as possible.

Figure 12:
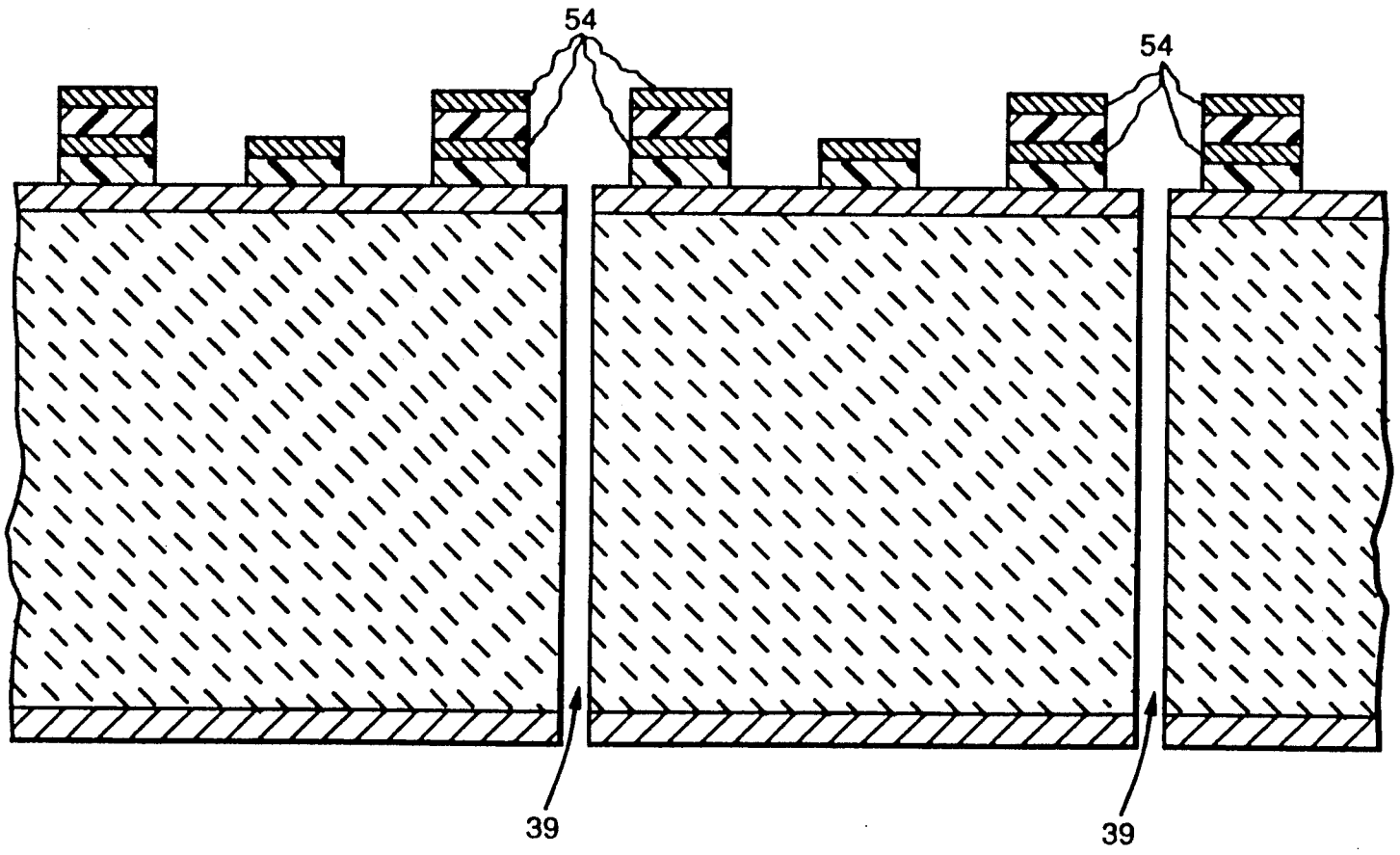
FIGS. 12 and 13 illustrate further alternative structures.
Figure 13:
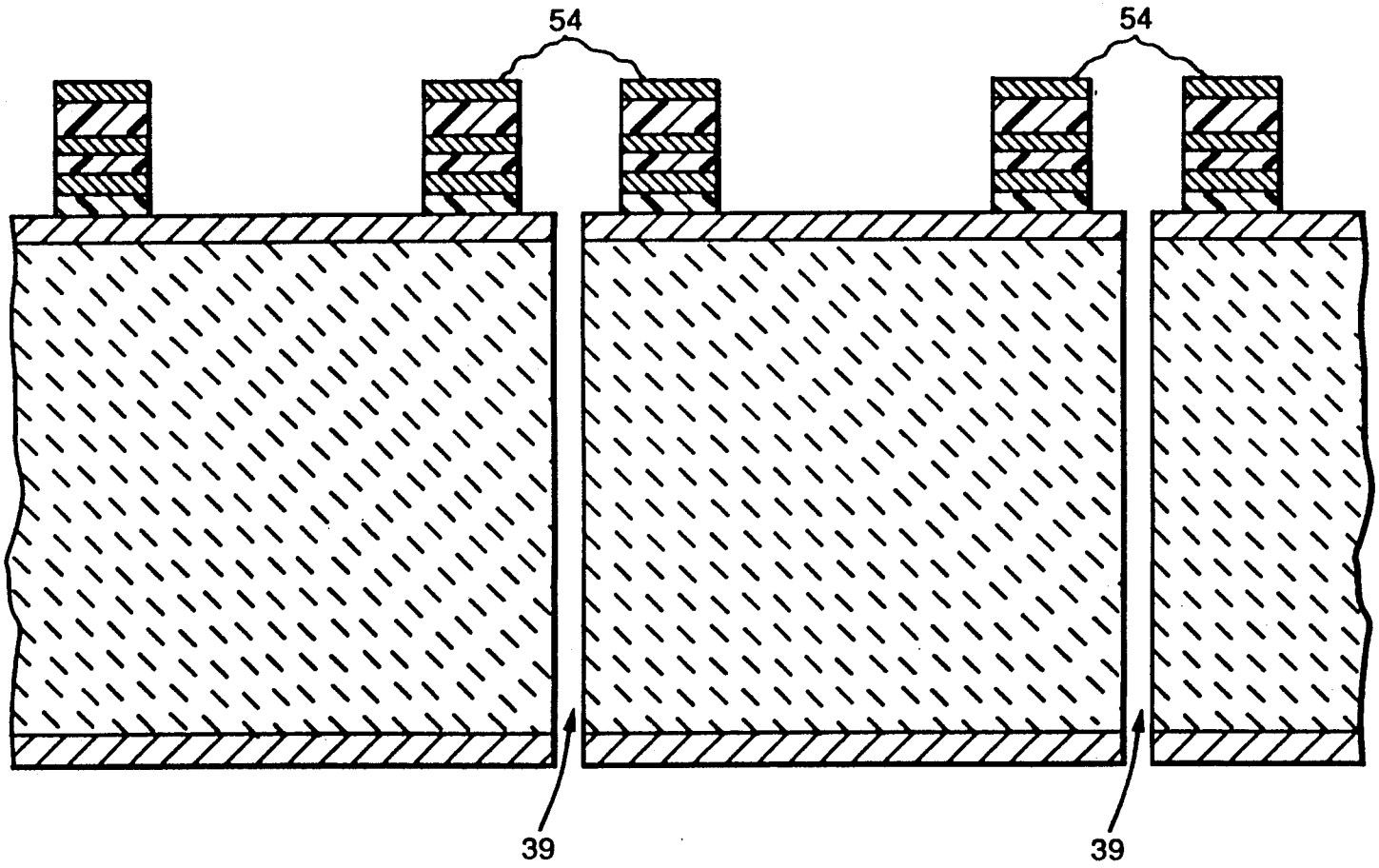

In order to minimize the area of the back surface of the array on which the high density interconnect dielectrics are disposed, in this removed-dielectric version of the structure, it is preferred that any ground conductors 54 be restricted to be vertically aligned with one of the signal conductors in the upper layer except over step portion 36 of the piezoelectric block. In this manner, substantial shielding is still obtained to minimize cross-talk between the underlying and overlying signal leads, while still allowing removal of as much of the dielectric as would be removed in the absence of the ground conductors $54_G$. The structure with the dielectric removed is illustrated in cross-section in FIGS. 12 and 13 with the cross-sections taken along the line 9—9 in FIG. 8. FIGS. 12 and 13 differ in that in FIG. 12, only two levels of metallization are present while in FIG. 13, three layers of metallization, including the ground layer $54_G$ are present and in the fact that the cross-section in FIG. 13 is taken along the line 13—13 in FIG. 8.

This method of fabrication is a substantial departure from the normal practice in the HDI interconnection art as set forth in the above-identified, related, background HDI patents and applications because that HDI work has focused on connecting many small components into a larger electronic system, whereas, this fabrication technique forms the HDI structure on a unitary body after which that body is diced to form many miniscule, physically isolated, elements which are maintained in substantially fixed physical relation despite the dicing of the unitary body.

That is, in the standard HDI process, individual separate components are mounted on a substrate, their actual locations determined and their contact pads interconnected to provide a complete system. In contrast, this fabrication process applies the HDI structure to a relatively large, uniform or undifferentiated body and after completion of the HDI fabrication, dices that body to form many miniscule, physically separate, elements. Thus, the subsequent dicing must be accurately aligned with the already fabricated HDI structure rather than vice versa. Further, this fabrication technique makes reworking of the HDI structure for repair purposes unworkable because of the need for continuous electrodes during the high temperature steps of the HDI fabrication process.

Figure 14:
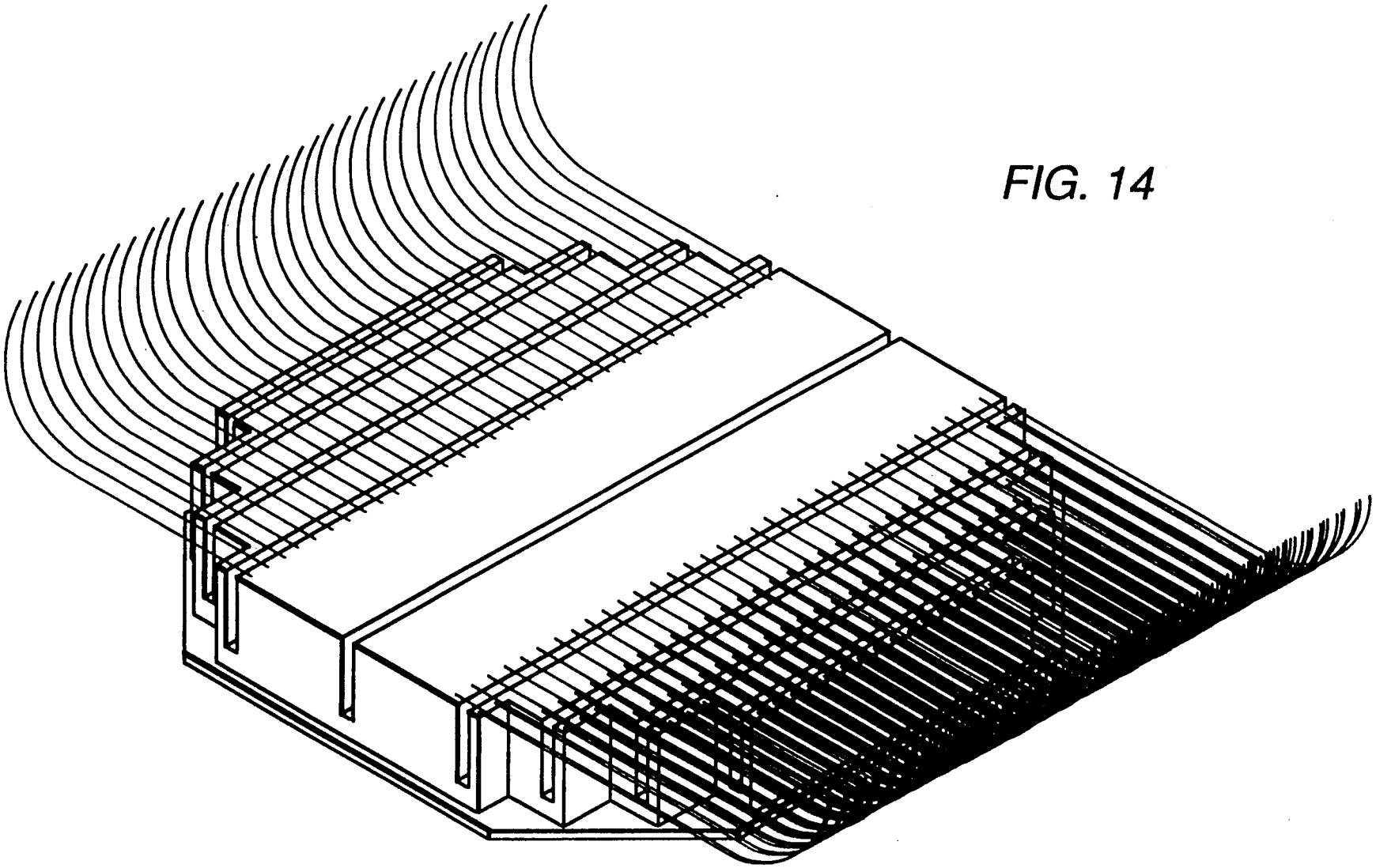
FIG. 14 illustrates an alternative configuration of the interconnect structure which facilitates the fabrication of a smaller overall transducer assembly.

While this high density interconnected ultrasonic array provides substantial advantages in being able to make contact to a large number of individual signal electrodes in a small space with a structure whose electrical characteristics are highly repeatable from array-to-array, it has the disadvantage, as illustrated thus far, of extending a substantial distance beyond the transducer body itself in order to avoid the dicing operation cutting whatever external terminal structure the signal leads extend to. This is disadvantageous where a small acoustic transducer probe is desired for ergometric or other reasons. In accordance with the related application Ser. No. 07/504,769, this disadvantage can be avoided by providing a flexible high density interconnect structure as shown in FIG. 14 where, after assembly, the high density interconnect structure which is laterally displaced from the piezoelectric ultrasonic transducer is rendered flexible by separation from a temporary support structure and may be bent away from the transducer so that the transducer end of an ultrasonic probe may be made substantially smaller than would otherwise be possible.

While this high density interconnect structure has been illustrated and described in connection with a two-dimensional ultrasonic array, it will be understood that it is equally applicable to a linear array. Further, while the high density interconnect structure has been illustrated and described as being disposed across the back surface of the transducer, it should be recognized that in a linear array, this high density interconnect structure could be fabricated along a side face of the array rather than along the back face of the array. Further, a plurality of such linear arrays could be appropriately juxtaposed to form a two-dimensional phased array. Consequently, although it is not preferred because of fabrication difficulties and issues of accurate alignment between adjacent, initially physically separate, subarrays, it is feasible to place the high density interconnect structure on some surface other than the back surface of the array. That other surface may include the front surface of the array, if desired, but such a procedure is not presently desired because of the interaction of the high density interconnect structure dielectric and signal conductors with the acoustic waves generated by the array which would tend to give the elements of different subarrays of the transducer different impulse responses which would degrade the phased array quality.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. An ultrasonic transducer comprising:

a plurality of ultrasonic transducer elements arranged in an array of parallel rows and parallel columns, said columns being disposed at an angle to said rows;

each of said elements including a signal electrode and a ground electrode;

each of said elements having associated therewith a layer of dielectric material and a signal conductor, said associated signal conductor being disposed on said associated layer of dielectric material and being ohmically connected to said signal electrode of its associated element;

the portions of said signal conductors which are disposed over said array being disposed parallel to said columns;

each of the signal conductors associated with an element of a column being disposed over said column; and at the edge of said array, two signal conductors which are disposed over a column being spaced apart by a ground conductor.

2. The ultrasonic transducer recited in claim 1 wherein:

said ground conductor is connected to the ground electrode for an element in that column.

3. The ultrasonic transducer recited in claim 2 wherein:

a plurality of the elements in said column have their ground electrodes connected to said ground conductor.

4. The ultrasonic transducer recited in claim 3 further comprising:

electronics coupling to said signal conductors for providing drive signals to or for receiving output signals from said elements for forming an ultrasonic beam.

5. An ultrasonic transducer comprising:

a plurality of ultrasonic transducer elements arranged in an array of rows and columns;

each of said elements including a signal electrode and a ground electrode, a plurality of said elements in a column having their ground electrodes connected together;

each of said elements having associated therewith a layer of dielectric material and a signal conductor, said associated signal conductor being disposed on said associated layer of dielectric material and being ohmically connected to said signal electrode of its associated element;

the signal conductors for first and second ones of said elements in said column extending over said first element in said column and being disposed on the dielectric layer associated with said first element; and a further dielectric layer disposed over said dielectric layer associated with said first and second elements in said column, said further dielectric layer being disposed over said signal conductors for said first and second elements; and a ground conductor disposed on said further dielectric layer.

6. The ultrasonic transducer recited in claim 5 wherein:

said ground conductor is connected to said ground electrode for said column.

7. The ultrasonic transducer recited in claim 6 wherein:

the dielectric layer associated with a third one of said elements in said column extends over said ground conductor.

8. The ultrasonic transducer recited in claim 7 wherein:

said first element is an outer element of said column;

said third element is an inner element of said column;

said ground conductor extends over at least a portion of said first element of said column;

the dielectric layer associated with said third one of said elements of said column is disposed over said ground conductor; and the signal conductor for said third element is disposed on said dielectric layer associated with said third element and extends over said first element.

9. The ultrasonic transducer recited in claim 8 wherein:

said signal electrode is disposed on a back surface of said element.

10. An ultrasonic transducer comprising:

a plurality of ultrasonic transducer elements arranged in an array of rows and columns;

each of said elements including a signal electrode and a ground electrode, a plurality of said elements in a column having their ground electrodes connected together;

each of said elements having associated therewith a layer of dielectric material and a signal conductor, said associated signal conductor being disposed on said associated layer of dielectric material and being ohmically connected to said signal electrode of its associated element;

the signal conductors for first and second ones of said elements in said column extending over said first element in said column;

the elements of adjacent columns being spaced apart in the row direction; and within the array the dielectric layers for adjacent columns being spaced apart in the row direction.

11. An ultrasonic transducer comprising:

a plurality of ultrasonic transducer elements arranged in an array of rows and columns;

each of said elements including a signal electrode and a ground electrode, a plurality of said elements in a column having their ground electrodes connected together;

each of said elements having associated therewith a layer of dielectric material and a signal conductor, said associated signal conductor being disposed on said associated layer of dielectric material and being ohmically connected to said signal electrode of its associated element;

a first layer of dielectric material being disposed on said elements of one of said columns, said first layer of dielectric material being associated with first and second elements of that column;

a first signal conductor extending over said first element, said first signal conductor being the one associated with said first element;

a second signal conductor extending across said first element, said second signal conductor being the one associated with said second element;

a second dielectric layer disposed over said first dielectric layer and said first and second signal conductors; and a ground conductor disposed on said second dielectric layer.

12. The ultrasonic transducer recited in claim 11 comprising:

a third dielectric layer disposed over said ground conductor, said third dielectric layer being associated with a third element of said column;

a third signal conductor disposed on said third dielectric layer, said third signal conductor being the one associated with said third element.

13. The ultrasonic transducer recited in claim 12 wherein:

a portion of the back of at least one element in said column is free of said dielectric material; and an acoustic absorber is disposed in contact with said portion of the back of said at least one element.

14. An ultrasonic transducer comprising:

a plurality of ultrasonic transducer elements arranged in an array of rows and columns;

each of said elements including a signal electrode and a ground electrode, a plurality of said elements in a column having their ground electrodes connected together;

each of said elements having associated therewith a layer of dielectric material and a signal conductor, said associated signal conductor being disposed on said associated layer of dielectric material and being ohmically connected to said signal electrode of its associated element;

a first layer of dielectric material being disposed on said elements of one of said columns, said first layer of dielectric material being associated with first and second elements of that column;

the elements of adjacent columns being spaced apart in the row direction; and within the array the dielectric layers for adjacent columns are spaced apart in the row direction.

15. An ultrasonic transducer comprising:

a plurality of ultrasonic transducer elements arranged in an array;

each of said elements including a signal electrode and a ground electrode;

each of said elements having associated therewith a layer of dielectric material and a signal conductor, said associated signal conductor being disposed on said associated layer of dielectric material and being ohmically connected to said signal electrode of its associated element; and along said element, said dielectric material being restricted to the vicinity of said signal conductor.

16. The ultrasonic transducer recited in claim 15 further comprising:

acoustic absorbing material disposed on those portions of the back surface of said array which are free of said dielectric material and over said dielectric material which is disposed on said array.

17. An ultrasonic transducer comprising:

a plurality of ultrasonic transducer elements arranged in an array;

each of said elements including a signal electrode and a ground electrode;

each of said elements having associated therewith a layer of dielectric material and a signal conductor, said associated signal conductor being disposed on said associated layer of dielectric material and being ohmically connected to said signal electrode of its associated element, and said back surface of said element being substantially free of said dielectric material except in the immediate vicinity of said signal conductors.

18. The ultrasonic transducer recited in claim 17 further comprising:

an acoustic absorbing material disposed in contact with said back surface of said element substantially everywhere except where said dielectric is disposed.

19. An ultrasonic transducer comprising:

a plurality of ultrasonic transducer elements arranged in an array;

each of said elements including a signal electrode and a ground electrode;

each of said elements having associated therewith a layer of dielectric material and a signal conductor, said associated signal conductor being disposed on said associated layer of dielectric material and being ohmically connected to said signal electrode of its associated element; and said layer of dielectric material comprising an acoustic absorbing material.

20. An electrical connection system for an acoustic phased array transducer of the type having substantially more columns than rows and a center line which separates said columns into substantially equal halves, said electrical connection system comprising:

a layer of dielectric material disposed over the elements of said array;

a plurality of signal conductors disposed on said layer of dielectric material and ohmically connected to associated elements of said array, said signal conductors being spaced from said centerline, being disposed substantially parallel to the length of said columns and extending from the vicinity of the ohmic connection between said conductor and said associated element in a direction away from said centerline; and said layer of dielectric material having gaps between adjacent columns which extend substantially the full height of the columns.

21. The electrical connection system recited in claim 20 wherein:

the contact between said signal conductor and said signal electrode is disposed off center on at least the center-most element in a direction away from the centerline of said array.

22. An electrical connection system for an acoustic phased array transducer of the type having substantially more columns than rows and a centerline which separates said columns into substantially equal halves, said electrical connection system comprising:

a layer of dielectric material disposed over the elements of said array;

a plurality of signal conductors disposed on said layer of dielectric material and ohmically connected to associated elements of said array, said signal conductors being spaced from said centerline, being disposed substantially parallel to the length of said columns and each extending from the vicinity of the ohmic connection between said conductor and said associated element in a direction away from said centerline; and said layer of dielectric material being restricted to the immediate vicinity of said signal conductors whereby each signal conductor has a separate trace of said dielectric material associated therewith.

23. A method of forming a connection system for connecting external electronics to the individual elements of a two dimensional ultrasonic acoustic array in which the elements area arranged in rows and columns, said method comprising:

providing a body of piezoelectric material having conductive signal electrode material disposed on a back surface thereof;

bonding a dielectric layer to the back of said body of piezoelectric material;

creating via holes in said dielectric layer;

forming a pattern of conductive material on said dielectric layer which comprises a plurality of separate signal conductors which are disposed in ohmic contact with said conductive signal electrode material at the bottoms of said via holes, said signal conductors being disposed substantially parallel to the lengths of columns of said array.

24. The method recited in claim 23 further comprising the step of:

separating said dielectric layer into separate segments between adjacent columns.

25. The method recited in claim 23 further comprising, after the step of forming, the step of:

removing said dielectric material except where it is aligned with a conductor which is disposed thereover.

26. The method recited in claim 23 further comprising the step of:

applying an additional layer of material over the back of said array, said dielectric layer of said pattern of conductors, the material of said additional layer being more acoustically damping than said dielectric layer and being disposed in contact with the back of said elements where said dielectric layer was removed.

* * * * *